US007749298B2

(12) United States Patent
Okajima et al.

(10) Patent No.: US 7,749,298 B2
(45) Date of Patent: Jul. 6, 2010

(54) IRON-BASED SINTERED ALLOY AND MANUFACTURING METHOD THEREOF

(75) Inventors: Hiroshi Okajima, Aichi-ken (JP); Satoshi Uenosono, Tokyo-to (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 54 days.

(21) Appl. No.: 10/569,800

(22) PCT Filed: Aug. 19, 2004

(86) PCT No.: PCT/JP2004/012232

§ 371 (c)(1),
(2), (4) Date: Nov. 15, 2006

(87) PCT Pub. No.: WO2005/021190

PCT Pub. Date: Mar. 10, 2005

(65) Prior Publication Data

US 2007/0154339 A1 Jul. 5, 2007

(30) Foreign Application Priority Data

Aug. 28, 2003 (JP) ..... 2003-209217

(51) Int. Cl.
*C22C 33/02* (2006.01)
*B22F 3/00* (2006.01)

(52) U.S. Cl. ..... 75/246; 75/236; 419/25; 419/38

(58) Field of Classification Search ..... 75/236, 75/243, 246; 419/11, 25, 29, 54, 38
See application file for complete search history.

(56) References Cited

U.S. PATENT DOCUMENTS

| | | | | |
|---|---|---|---|---|
| 4,840,665 | A * | 6/1989 | Fujii | 75/241 |
| 6,019,937 | A * | 2/2000 | Shivanath et al. | 419/14 |
| 2001/0015244 | A1 | 8/2001 | Kiuchi et al. | |

FOREIGN PATENT DOCUMENTS

| | | |
|---|---|---|
| EP | 0 462 779 | 12/1991 |
| EP | 0 677 591 | 10/1995 |
| EP | 0 745 695 | 12/1996 |
| JP | 63-042357 | 2/1988 |
| JP | 3-61349 | 3/1991 |

* cited by examiner

*Primary Examiner*—Roy King
*Assistant Examiner*—Ngoclan T Mai
(74) *Attorney, Agent, or Firm*—Finnegan, Henderson, Farabow, Garrett & Dunner, LLP

(57) ABSTRACT

To provide an iron-based sintered alloy excellent in shape accuracy and wear resistance, and reduced hostility to mating materials, and having sufficient hardness after tempering, as well as a manufacturing method thereof. Iron-based alloy powder of a composition comprising Cr: from 1 to 3.5 mass %, Mo: from 0.2 to 0.9 mass %, V: from 0.1 to 0.5 mass % and the balance of Fe and impurities, and carbon powder are mixed at a ratio of the carbon powder based on the entire portion within a range from 0.8 to 1.1 mass %, the mixture is compacted, the compacted body is sintered and quenching is applied to the sintered body heated again after once lowering temperature of the sintered body. This can provide an iron-based sintered alloy where fine $M_7C_3$ carbides are dispersed in martensitic texture.

14 Claims, 3 Drawing Sheets

IRON-BASED SINTERED ALLOY AND MANUFACTURING METHOD THEREOF

TECHNICAL FIELD

The present invention concerns an iron-based sintered alloy of excellent resistance to temper softening, and a manufacturing method thereof. More specifically, it relates to an iron-based sintered alloy excellent in wear resistance, reduced hostility to mating materials and resistance to contact fatigue, and also suitable to net shape, as well as a manufacturing method thereof.

BACKGROUND ART

Heretofore, iron-based sintered alloys have been used as materials for machinery elements such as engine cam shafts in sliding movement with other members while bearing high surface contact stress. Existent iron-based sintered alloys for use in cam shafts have been generally manufactured by liquid phase sintering using materials of high carbon composition (about 1.5 to 3 mass %). This intends to ensure wear resistance by increasing density and dispersing coarse carbides (grain size of about several μm to several tens μm). Further, since it goes by way of a solid-liquid coexistent state, this also provides a merit capable of diffusion joining of a cam piece and a shaft at the same time with sintering. On the other hand, solid phase sintering has also been used. In this case, there is a method of integrating a cam piece with a shaft by mechanical joining, pipe expansion joining or shrinkage fitting after sintering and heat treatment. Shrinkage fitting is most advantageous for reducing operation burden upon grinding finishing. Existent iron-based sintered alloys of this type can include, for example, those described in Patent Document 1.

[Patent Document 1] Japanese Unexamined Patent Publication No. 63-42357

However, net shaping has been demanded in recent years for parts with sintered alloys. This is because the demand has been increased for simplification of steps, or increase in degree of freedom for profiles, particularly, in cam pieces. For this purpose, existent iron-based sintered alloys involve the following problems. At first, in a case of liquid phase sintering, it involves a problem that shrinkage upon sintering is large and surface flatness is poor. Therefore, grinding finishing is indispensable and it cannot cope with the demand for net shaping. On the other hand, in a case of integration with a shaft by mechanical joining or pipe expansion joining by using solid phase sintering, it involves a problem that concentricity with the shaft is poor. Therefore, grinding finishing for cam profile surfaces cannot be saved after all. Further, coarse grains of carbides are dispersed in the iron-based sintered alloys in this case. Therefore, it results in a problem of high hostility to mating materials in sliding movement. Use of solid phase sintering and shrinkage fitting is advantageous in view of net shaping but it has a problem that hardness cannot be ensured sufficiently. This is because the cam piece is tempered upon shrinkage fitting. Thus, durability is insufficient.

DISCLOSURE OF THE INVENTION

The present invention has been achieved by considering foregoing circumstance in the existent iron-based sintered alloys. That is, it is a subject thereof to provide an iron-based sintered alloy excellent in shape accuracy, wear resistance and reduced hostility to mating materials, and having a sufficient hardness after tempering, as well as a manufacturing method thereof. It intends to cope with the demand for net shaping of a member such as a cam piece.

An iron-based sintered alloy of the present invention has a composition containing, in a matrix comprising martensite, $Cr_7C_3$ carbide, $Mo_7C_3$ carbide and $M_7C_3$ carbides (M represents one or more members selected from the group consisting of the group 4a or group 5a metals), comprising Cr: from 1 to 3.5 mass %, Mo: from 0.2 to 0.9 mass %, group 4a or group 5a metal: from 0.1 to 0.5 mass % (more preferably, from 0.18 to 0.38 mass %) being converted as V, C: from 0.7 to 1.1 mass %, Mn: 0.7 mass % or less, and the balance of Fe and impurities.

In a case where the group 4a or group 5a metal is other than V, the compositional range thereof is converted based on the ratio of atomic weights between the metal and V (here and hereinafter). The group 4a metal may be any of Ti, Zr and Hf and the group 5a metal may be any of V, Nb, and Ta.

Further, a method of manufacturing an iron-based sintered alloy according to the present invention is a method of manufacturing an iron-based sintered alloy, comprising the steps of: mixing an alloy powder of a composition comprising Cr: from 1 to 3.5 mass %, Mo: from 0.2 to 0.9 mass %, group 4a or group 5a metal: from 0.1 to 0.5 mass % (more preferably, from 0.18 to 0.38 mass %), Mn: 0.7 mass % or less and the balance of Fe and impurities, and a carbon powder at a ratio of the carbon powder to the alloy powder within range from 0.8 to 1.1 mass %; compacting the mixture; sintering the compacted body; and applying quenching from a temperature of 800° C. or higher after the temperature of the sintered body has been lowered to 150° C. or lower. In this case, a lubricant may also be mixed in addition to the alloy powder and the carbon powder.

In the iron-based sintered alloy of the present invention, since the carbon content is not so high, sintering is conducted as solid phase sintering. Then, already in the stage after sintering, minute nuclei of $M_7C_3$ carbides in which M is group 4a or group 5a metal are present. Then, by the heating before quenching, the $M_7C_3$ carbides precipitate while incorporating also Cr and Mo with the minute nuclei as initiation points. In the stage after the quenching, various ingredient elements described above are present in part as $M_7C_3$ carbides while the remaining part are solid solved in the Fe matrix. Therefore, the matrix is in a martensitic structure. Then, the $M_7C_3$ carbides are present in the matrix of the martensite. The carbides cause pinning to the grain boundary of the martensite during subsequent tempering to inhibit formation of coarse martensitic grains. This increases basic hardness of the iron-based alloy and ensures hardness of the iron-based sintered alloy after tempering.

As described above, since solid phase sintering can be conducted in the present invention, shape accuracy and surface flatness are excellent and subsequent grinding finishing is not necessary. Further, in a case of integrating by shrinkage fitting with other member (for example, cam piece and shaft), hardness after the shrinkage fitting can be ensured. As described above, an iron-based sintered alloy capable of net shape and having high resistance to temper softening is attained, as well as a manufacturing method thereof. Iron-based alloy powder used as raw material may also contain elements contained generally in steels as inevitable impurities, in addition to each of the alloying ingredients described above.

In the iron-based sintered alloy and the manufacturing method thereof according to the present invention, it is preferable that average grain size of carbides is 400 nm or less at the stage after quenching. This is because the pinning effect to the crystal grain boundary is decreased and, further, hostility to mating materials in sliding movement is increased in a case where carbides are excessively large. Average grain size of carbides may be measured by scanning electron microscope or transmission electron microscope.

Further, in the iron-based sintered alloy and the manufacturing method thereof according to the present invention, it is preferred that ratio of Cr, Mo, and group 4a or group 5a metal in the carbides to the entire iron-based sintered alloy at the stage after quenching is within ranges of 0.6 to 0.9 mass % for Cr, 0.05 to 0.3 mass % for Mo, and 0.1 to 0.4 mass % for group 4a or group 5a metal. That is, remaining Cr, Mo, and group 4a or group 5a metal are solid solved in the matrix. This can ensure necessary and sufficient amount of the $M_7C_3$ carbides and stabilization of martensite of the matrix.

Further, in an iron-based sintered alloy and the manufacturing method thereof according to the present invention, it is preferred that the oxygen content is less than 0.2 mass % at the stage after the sintering. This can be attained by keeping retention temperature during the sintering at 1200° C. or higher. This is because Cr oxides in the alloy powder of the raw material are reduced. The sintering is promoted by low oxygen content, so that strength of the iron-based sintered alloy after quenching and after tempering can be ensured.

Further, in the iron-based sintered alloy and the manufacturing method thereof according to the present invention, it is preferred that retention temperature before quenching is within a range from 820 to 910° C. Further, it is preferred that retention time at the retention temperature is 25 min or more.

BEST MODE FOR CARRYING OUT THE INVENTION

A preferred embodiment of the present invention is to be described specifically. In this embodiment, the present invention is applied to a process of manufacturing a cam piece for a cam shaft for use in an internal combustion engine by solid phase sintering starting from alloy powder and carbon powder as main raw materials. In this embodiment, it is premised on a process not applying grinding finishing, and a manufactured cam piece is integrated with a shaft by shrinkage fitting.

In this embodiment, alloy powder and carbon powder are used as main raw materials. The alloy powder is a supplying source for elements other than C among various ingredients of the iron-based sintered alloy after sintering. The carbon powder is a supplying source for C among various ingredients of the iron-based sintered alloy after sintering. Accordingly, the alloying powder used in this embodiment has to comprise Fe as main ingredient and has to contain Cr, Mo, and group 4a or group 5a metal as alloying elements. The group 4a metal may be any of Ti, Zr and Hf, while the group 5a metal may be any of V, Nb and Ta. In addition to them, elements contained generally in steels as inevitable impurities may naturally be contained. On the other hand, content of C in the alloy powder may be as low as possible. This is because C is supplied from the carbon powder. In this embodiment, powder of lubricant is used as raw material powder other than described above. This is used generally in the powder metallurgy.

Figure 1:
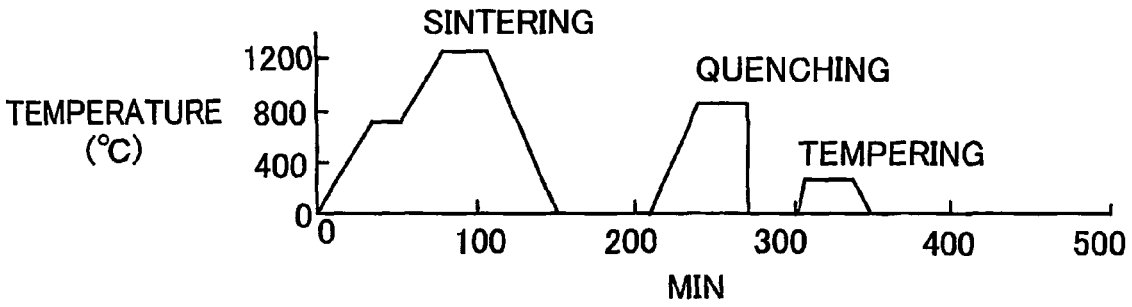
FIG. 1 is a graph showing outline of thermal hysteresis in manufacturing step of a cam shaft in a preferred embodiment.

In this embodiment, the raw material powders described above are mixed together and compacted into a net shape form of a cam piece. Then, it is sintered and, further, quenched. The thus obtained cam piece is integrated with the shaft by shrinkage fitting. Thus, the cam shaft is manufactured without by way of a grinding finishing step. FIG. 1 shows outline for a thermal hysteresis from the sintering to the shrinkage fitting. In FIG. 1, a portion indicated as "sintering" corresponds to the sintering, a portion indicated as "quenching" corresponds to the quenching and a portion indicated as "tempering" corresponds to the shrinkage fitting, respectively.

In this case, nuclei of $M_7C_3$ carbides are present in the matrix already at the final stage of sintering. However, at this stage, almost of M in the carbides is a group 4a or group 5a metal. This is because carbides of metals of this kind can be present stably even at a high temperature compared with carbides of other metals. Then, after sintering and before quenching, temperature of the sintered product is once lowered to 150° C. or lower. Thus, $A_3$ transformation is completed and a martensite or bainite texture is formed as the matrix.

Subsequently, the sintered product is re-heated and kept hot for a while to conduct quenching. During retention of the temperature, the nuclei of $M_7C_3$ carbides grow to some extent. At this stage, not only the group 4a or group 5a metals but also Cr and Mo are taken into $M_7C_3$ carbides. Thus, a state is obtained where fine carbides with an average grain size of about 400 nm are dispersed in the matrix (base metal). Quenching is applied at this stage. Accordingly, grain boundaries of the matrix are pinned by the fine carbides to obtain a martensitic texture having fine crystal grains. Further, super saturated C and alloying elements are solid solved to some extent in the matrix after quenching.

Thus obtained cam piece is integrated with the shaft by shrinkage fitting. Grinding finishing step is not necessary in this case. This is because it is formed by solid phase sintering excellent in the shape accuracy and the surface flatness. Further, the cam piece after shrinkage fitting has sufficient wear resistance, hardness and strength as the cam shaft for use in the internal combustion engines. This is because the matrix is constituted with martensite, fine $M_7C_3$ carbides are dispersed and, further, it has a texture of fine crystal grains. On the other hand, hostility to mating materials in sliding movement is not so strong. That is, it is excellent in reduced hostility to mating materials. This is because average grain size of $M_7C_3$ carbides is as small as about 400 nm.

Figure 2:
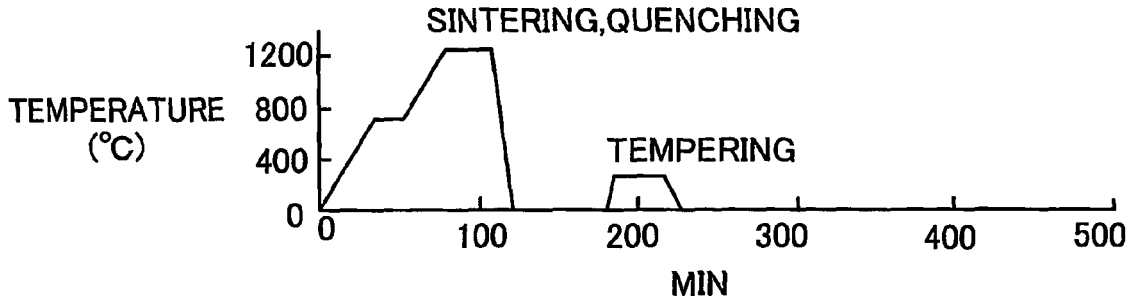
FIG. 2 is a graph showing a thermal hysteresis in a case of applying quenching just after sintering.
Figure 3:
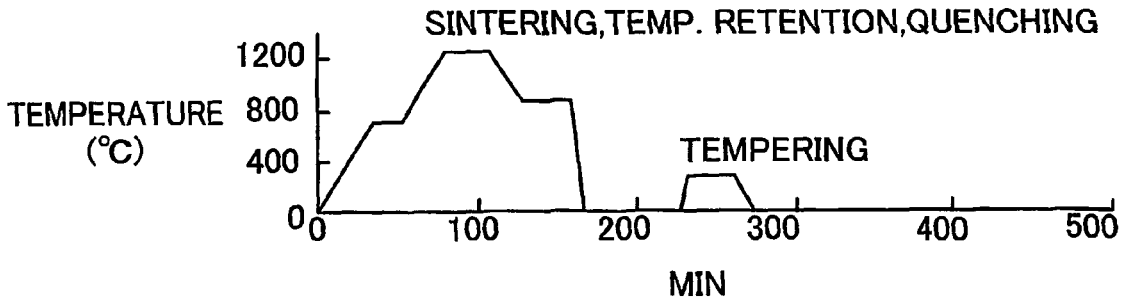
FIG. 3 is a graph showing a thermal hysteresis in a case of retaining quenching temperature in the course of cooling after sintering and quenching.

Here will be described a result of a study whether or not characteristics identical with described above can be obtained in cases of adopting thermal hysteresis different from that shown in FIG. 1. FIG. 2 shows a thermal hysteresis in a case of quenching to a room temperature immediately after sintering. FIG. 3 shows a thermal hysteresis in a case of keeping quenching temperature in the course of cooling after sintering and then quenching. According to experiments made by the present inventors, no sufficient precipitation of $M_7C_3$ carbides could be obtained either in FIG. 2 or in FIG. 3. Accordingly, they were softened by tempering upon shrinkage fitting and no sufficient strength could be obtained after shrinkage fitting. The reason why no sufficient carbides can be obtained by the thermal hysteresis in FIG. 2 is considered to be attributable to the absence of timing for growing of $M_7C_3$ carbides. That is, nuclei of carbides are present at the final stage of sintering even in this thermal hysteresis. However, they do not grow. Further, also in a case of keeping at quenching temperature in the course of cooling after sintering as shown in FIG. 3, growth of carbides was also insufficient. The reason is assumed that since martensitic texture of the matrix is not yet formed during temperature retention, temperature retention at this stage does not lead to the growth of carbide nuclei. As described above, in this embodiment, it is necessary to once cool to vicinity of room temperature after sintering and then applying quenching subsequently as shown in FIG. 1.

Even in the thermal hysteresis as shown in FIG. 2 and FIG. 3, precipitation of $M_7C_3$ carbides can be obtained by further increasing content of group 4a or group 5a metals. However, use of such means is not preferred. This is because sintered alloy of high density can not be obtained aside from the problem of the cost. The reason is that alloy powder containing a great amount of group 4a or group 5a metal is hard itself. Accordingly, a great amount of voids are left during compacting and only sintered alloys of low density can be obtained. Accordingly, durability is insufficient.

Then, compositional range for each alloying element is to be studied. At first for Cr, its preferred range is from 1 to 3.5 mass %, especially from 1 to 2.5 mass %. For Mo, its preferred range is from 0.2 to 0.9 mass %, especially from 0.4 to 0.9 mass %. For group 4a or group 5a metal, its preferred range is from 0.1 to 0.5 mass % in a case of V. In a case of element other than V, it may suffice that the converted value obtained by dividing the composition of the element (mass %) with atomic weight of the element, which is then multiplied with atomic weight of V is within a range described above. In a case of containing two or more group 4a or group 5a metals, the total for the conversion values for each of the elements (V being as it is) may be within the range described above. Such elements are those for constituting ingredient (M) of $M_7C_3$ carbides. Accordingly, in a case where they are insufficient, it results in a problem that $M_7C_3$ carbides are not sufficiently formed. Particularly, the group 4a or the group 5a metal is indispensable for the formation of nuclei as the initiation points at which $M_7C_3$ carbides are precipitated. On the other hand, in a case where they are excessive, it results in a problem of forming coarse $M_7C_3$ carbides tending to increase hostility to mating materials in sliding movement. Further, since such elements have a strong affinity with oxygen O, it may be a worry of incorporating O during sintering or the like to lower the strength of sintered alloy. Of course it results in a problem of the cost as well. For them and Mn, it may be considered that composition in the alloy powder of the raw material constitutes as they are composition in the sintered alloy (as total of matrix and precipitates).

For C (carbon powder), a preferred range for its mixing ratio is from 0.8 to 1.1 mass %. In a case where C is insufficient, it will be apparent that $M_7C_3$ carbides are not formed sufficiently. On the contrary, in a case where C is excessive, it may possibly form coarse $M_7C_3$ carbides, or hetero phases such as cementite or pearlite. Further, since sintering tends to be liquid phase sintering, it is disadvantageous also in view of the shape accuracy and the surface flatness. A preferred range for Mn content is 0.7 mass % or less. Since Mn decreases oxygen content by deoxidation effect, it has an effect of obtaining a sintered product of high hardness easily. On the other hand, since Mn, unlike Si, does not form coarse carbides, it is excellent in reduced hostility to mating materials. Therefore, it is preferred that Mn is contained by 0.09 mass % or more, especially 0.3 mass % or more. However, in a case where Mn content is excessively high, since shape of alloy powder is rounded to deteriorate the moldability, upper limit is defined as 0.7 mass % (more preferably, 0.62 mass %).

Successively, conditions for temperature in each step, etc. are to be studied. At first, sintering temperature is preferably 1200° C. or higher. It has been considered so far that sintering temperature of about 1120° C. is sufficient. However, in the present invention, since sintering is conducted at 1200° C. or higher which is higher than usual, oxides of metals (particularly, Cr) contained in the alloy powder of the raw material are sufficiently reduced. This can suppress O content in the sintered alloy to less than 0.20 mass % (about 0.25 to 0.35 mass % in a case of sintering at about 1120° C.). This is advantageous for ensuring strength of the cam piece after shrinkage fitting. Further, in a case where sintering temperature is excessively high, it results in worsening of shape accuracy and increase in the cost, which is not desirable. Accordingly, it is preferably at 1300° C. or lower.

After sintering, it is necessary to once lower temperature of the sintered body to the vicinity of room temperature. This is for growing $M_7C_3$ carbides sufficiently as also shown in the result for the study of the thermal hysteresis described above. That is, the present inventors assume that martensitic texture of the matrix necessary for growing of $M_7C_3$ carbides can be formed sufficiently by lowering temperature of the sintered body after sintering once to the vicinity of room temperature. As a result of a further study made by the present inventors, it has been found necessary that temperature of the sintered body should once be lowered to 150° C. or lower after sintering in order to obtain the effect described above.

Then, for quenching, retention temperature before quenching is kept at 800° C. or higher. In a case where retention temperature is lower, it naturally results in insufficient quenching. Therefore, hardness of the matrix is insufficient. On the other hand, in a case where retention temperature is excessively high, $M_7C_3$ carbides are rather decreased, making it difficult to obtain intended characteristics. Therefore, retention temperature is preferably 910° C. or lower. Especially preferable range of retention temperature is from 820° C. to 840° C. Further, it is preferred to ensure retention time at the retention temperature for 25 min or more in order to grow nuclei of $M_7C_3$ carbides to some extent. In this way, a sintered alloy having a sufficient hardness can be obtained by dispersion strengthening due to precipitation of $M_7C_3$ carbides. Crystal grains of martensite are also considerably fine and it is considered that this also contributes to the hardness. This is because $M_7C_3$ carbides are dispersed, and have an effect of pinning martensitic grain boundaries.

Figure 4:
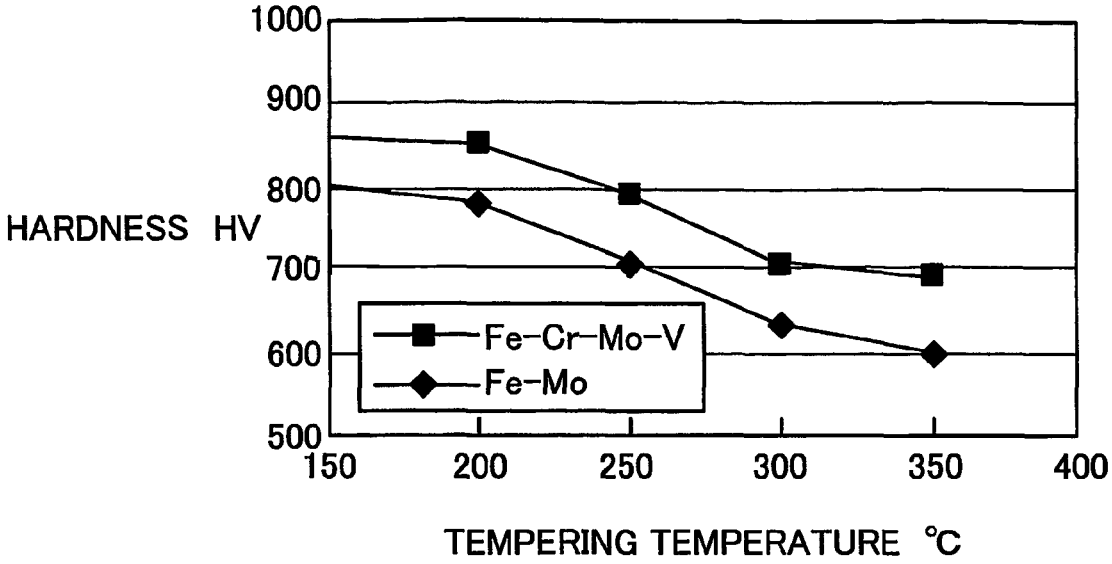
FIG. 4 is a graph showing a relation between tempering temperature and hardness.

Subsequent shrinkage fitting, that is, tempering is preferably conducted at 300° C. or lower. This is because hardness of the sintered alloy after tempering is made lower as tempering temperature is higher as shown by the graph in FIG. 4. Further, in a case where tempering temperature is high, tempering embrittlement tends to occur. The graph shown in FIG. 4 shows a case of an Fe—Cr—Mo—V alloy according to this embodiment and a case of an Fe—Mo alloy as a comparison. While trend to tempering temperature is identical, the Fe—Cr—Mo—V alloy is more excellent entirely in view of hardness. Further, in a case where shrinkage fitting temperature is excessively low, this naturally hinders shrinkage fitting operation itself.

Example

Examples and comparative examples are shown below. In the examples and the comparative examples, for species of group 4A or group 5a metal, V belonging to the group 5a was used in all of the cases. Then, as alloy powder for raw material, those commercially available complete alloyed powders having compositions shown in Table 1 were used. In any of the cases, the balance comprises substantially Fe.

TABLE 1

| | Composition of alloy powder (mass %) | | | |
|---|---|---|---|---|
| No. | Cr | Mo | V | Mn |
| 1 | 1.0 | 0.92 | 0.23 | 0.11 |
| 2 | 2.0 | 0.41 | 0.38 | 0.12 |
| 3 | 3.0 | 0.28 | 0.31 | 0.10 |
| 4 | 3.5 | 0.33 | 0.19 | 0.19 |
| 5 | 2.5 | 0.50 | 0.18 | 0.62 |
| 6 | 2.0 | 0.79 | 0.23 | 0.23 |
| 7 | 3.0 | 0.21 | 0.35 | 0.12 |
| 8 | 3.0 | 0.28 | 0.31 | 0.10 |
| 9 | 2.0 | 0.15 | — | 0.44 |
| 10 | 3.0 | 0.21 | 1.0 | 0.15 |
| 11 | 0.21 | 0.10 | 0.21 | 0.09 |
| 12 | 5.9 | 0.41 | 0.32 | 0.13 |
| 13 | 2.5 | 0.24 | 0.25 | 0.29 |
| 14 | 2.9 | 0.20 | 0.40 | 0.24 |
| 15 | — | 1.51 | — | — |
| 16 | — | 0.59 | — | 0.20 |
| 17 | 1.0 | 0.19 | — | 0.70 |
| 18 | 3.1 | 0.30 | 0.29 | 0.10 |

In Table 1, alloy powders of Nos. 9 and 17 lack in V. The alloy powder of No. 10 contains excessive V content. The alloy powder of No. 11 contains insufficient Cr. The alloy powder of No. 12 contains excessive Cr. Alloy powders of Nos. 15 and 16 lack in Cr and V. As described above, the alloy powders of Nos. 9 to 12 and 15 to 17 have compositions out of the preferred range. Compositions of the alloy powders of Nos. 1 to 8, 13, 14, and 18 are within the preferred range.

Successively, Tables 2 and 3 show mixing conditions and conditions for heat treatment, etc. In Tables 2 and 3, the column for "amount of carbon" and columns for "lubricant" show blending ratios in each of mixing with alloy powder as mass ratio relative to the total of alloy powder, carbon powder and lubricant. The balance is alloy powder. For carbon powder, natural graphite powder with an average grain size of 12 μm was used. In view of above, in Comparative Examples 1 to 4 and 7 to 9, compositions of alloy powders used are out of the preferred range. In Comparative Example 5, while the composition of the alloy powder used is within the preferred range, mixing amount of carbide is excessively small. Further, in comparative Example 6, while the composition of the alloy powder used is within the preferred range, mixing amount of carbon is excessive. In Comparative Example 10, while both of the composition of the alloy powder and the amount of carbon are within preferred ranges, conditions of heat treatment to be described later are not appropriate. For lubricant, types thereof are also shown in Tables 2 and 3. That is, Tables 2 and 3 show Zn stearate as ①, Li stearate as ②, and ethylenebisstearic amide as ③, respectively. Raw materials were mixed to each other for 15 min by using a V blender both for examples and comparative examples.

TABLE 2

| Example No. | Powder No. | Amount of carbon (mass %) | Lubricant Type | Lubricant Amount (mass %) | Compacting and Sintering | Quenching |
|---|---|---|---|---|---|---|
| 1 | 1 | 0.9 | ① | 0.8 | A. | F. |
| 2 | 2 | 0.9 | ② | 0.9 | B. | |
| 3 | 3 | 1.1 | ② | 0.65 | C. | |
| 4 | 4 | 1.0 | ② | 0.3 | E. | |
| 5 | 5 | 0.9 | ③ | 0.7 | A. | |
| 6 | 6 | 1.1 | ③ | 0.8 | B. | |
| 7 | 7 | 1.0 | ② | 0.6 | C. | |
| 8 | 8 | 1.0 | ② | 0.7 | D. | |

TABLE 3

| Comp. Example No. | Powder No. | Amount of carbon (mass %) | Lubricant Type | Lubricant Amount (mass %) | Compacting and Sintering | Quenching |
|---|---|---|---|---|---|---|
| 1 | 9 | 0.9 | ② | 0.2 | E. | F. |
| 2 | 10 | 1.1 | ③ | 0.7 | B. | |
| 3 | 11 | 1.0 | ① | 0.8 | A. | |
| 4 | 12 | 0.9 | ② | 0.9 | B. | |
| 5 | 13 | 0.7 | ③ | 0.8 | B. | |
| 6 | 14 | 1.6 | ③ | 0.75 | B. | |
| 7 | 15 | 0.9 | ① | 0.8 | B. | |
| 8 | 16 | 0.9 | ② | 0.75 | B. | |
| 9 | 17 | 1.0 | ③ | 0.75 | B. | |
| 10 | 18 | 1.1 | ① | 0.65 | C. | G. |

In Tables 2 and 3, column for "Compacting and Sintering" shows the way material after mixing was molded and sintered by one of the followings A. to E.

A. (compacting once+sintering once)
Compacting (686 MPa)
↓
Sintering (1250° C., vacuum atmosphere, 60 min.)

B. (compacting twice+sintering twice)
Compacting (686 MPa)
↓
Pre-sintering (850° C., vacuum atmosphere)
↓
Room temperature
↓
Repressing (686 MPa)
↓
Resintering (1250° C., vacuum atmosphere, 60 min.)

C. (warm compaction once+sintering once)
Pre-heating (raw material powder at 140° C., mold at 160° C.)
↓
Repressing (686 MPa)
↓
Sintering (1250° C., reducing atmosphere, 60 min.)

D. (warm compaction once+sintering once)
Pre-heating (raw material powder at 140° C., die at 160° C.)
↓
Compacting (686 MPa)
↓
Sintering (1120° C., reducing atmosphere, 30 min.)

E. (warmed molding once+sintering once)

Lubricant (Li stearate) coated on die

↓

Pre-heating (raw material powder at 140° C., die at 120° C.)

↓

Compacting (686 MPa)

↓

Sintering (1230° C., vacuum atmosphere, 60 min.)

In a case where the process of (compacting twice+sintering twice) is adopted as described in B. above, sintered alloy of higher density can be obtained. For "reducing atmosphere" in C. above, 90 vol % $N_2$–10 vol % $H_2$ atmosphere was used actually. When lubricant is previously coated on a mold as described in E. above, the amount of lubricant to be mixed with the raw material powder can be decreased by so much. Thus, sintered alloy of higher density can be obtained.

In Tables 2 and 3, column for "Quenching" shows the way the alloy after sintering is quenched by one of the following F. and G.

F. Cooling gradually once to room temperature

↓

Heating at 865° C. and keeping for 30 min.

↓

Oil quenching (to 150° C.)

G. Quenching from sintered temperature as it is (100° C./min.)

G. described above is a process of directly conducting quenching after sintering as it is without once cooling to the room temperature. This is a process of applying the thermal hysteresis shown in FIG. 2 to the sintered alloy. As apparent from Tables 2 and 3, the process G. was used only for Comparative Example 10. The process F. was used for all other examples and comparative examples.

Then, each of the sintered alloys after hardening by the process F. or G. was kept in an atmospheric air at 300° C. for 30 min and then allowed to cool. This is tempering that simulated the thermal hysteresis during shrinkage fitting.

Tables 4 and 5 show composition, density, and Vickers hardness (HV, according JIS Z 2244) for each of the sintered alloys after quenching. As apparent from Tables 4 and 5, content of oxygen O is at most about 0.10 mass % in each of the examples and the comparative examples (except for Example 8). This shows deoxidation effect by conducting sintering at a relatively high temperature as described above. Further, each of the examples and the comparative examples has a favorable density of 7.00 g/cm$^3$ or higher. Particularly, the density tends to be high in specimens applied with the compaction and sintering by the process B. or E. (refer to Tables 2 and 3).

TABLE 4

| Example | Composition of sintered alloy (mass %) | | | | | | Density | Hardness |
|---|---|---|---|---|---|---|---|---|
| No. | Cr | Mo | V | Mn | C | O | g/cm$^3$ | HV |
| 1 | 1.0 | 0.90 | 0.22 | 0.10 | 0.75 | 0.09 | 6.98 | 652 |
| 2 | 2.0 | 0.40 | 0.38 | 0.12 | 0.72 | 0.07 | 7.48 | 692 |
| 3 | 3.0 | 0.28 | 0.30 | 0.09 | 0.92 | 0.06 | 7.31 | 719 |
| 4 | 3.5 | 0.32 | 0.20 | 0.21 | 0.83 | 0.09 | 7.40 | 707 |
| 5 | 2.5 | 0.49 | 0.18 | 0.62 | 0.73 | 0.09 | 7.12 | 699 |
| 6 | 2.0 | 0.80 | 0.22 | 0.22 | 0.91 | 0.08 | 7.52 | 683 |
| 7 | 3.0 | 0.20 | 0.35 | 0.13 | 0.85 | 0.10 | 7.48 | 714 |
| 8 | 3.1 | 0.28 | 0.30 | 0.13 | 0.95 | 0.23 | 7.43 | 708 |

TABLE 5

| Comp. Example | Composition of sintered alloy (mass %) | | | | | | Density | Hardness |
|---|---|---|---|---|---|---|---|---|
| No. | Cr | Mo | V | Mn | C | O | g/cm$^3$ | HV |
| 1 | 1.9 | 0.15 | — | 0.43 | 0.76 | 0.07 | 7.49 | 620 |
| 2 | 2.9 | 0.20 | 1.00 | 0.15 | 0.95 | 0.08 | 7.38 | 732 |
| 3 | 0.2 | 0.11 | 0.19 | 0.08 | 0.85 | 0.09 | 7.10 | 643 |
| 4 | 6.0 | 0.39 | 0.29 | 0.12 | 0.74 | 0.13 | 7.23 | 723 |
| 5 | 2.4 | 0.25 | 0.25 | 0.30 | 0.60 | 0.11 | 7.50 | 630 |
| 6 | 3.0 | 0.19 | 0.40 | 0.25 | 1.41 | 0.07 | 7.22 | 707 |
| 7 | — | 1.48 | — | — | 0.81 | 0.07 | 7.47 | 633 |
| 8 | — | 0.57 | — | 0.21 | 0.78 | 0.09 | 7.57 | 614 |
| 9 | 1.0 | 0.18 | — | 0.68 | 0.92 | 0.05 | 7.51 | 621 |
| 10 | 3.0 | 0.30 | 0.30 | 0.10 | 1.04 | 0.07 | 7.32 | 618 |

Vickers hardness in Tables 4 and 5 shows a value under a measuring load of 0.1 kgf (0.98 N). Each of the examples shows a favorable value. This is considered to be attributable to that the carbides precipitate favorably in the matrix. However, those of insufficient hardness are observed in comparative examples. They are Comparative Examples 1, 3, 5, 7 to 10.

The reason for the insufficiency of the hardness in Comparative Examples 1, 3, 5, and 7 to 10 is considered to be attributable to insufficient precipitation of carbides. It is considered for Comparative Examples 1 and 9 that nuclei of carbides are scarcely generated at the final stage of sintering because V is not contained as ingredient. Further, it is considered that growth of nuclei is also insufficient because of insufficiency of Mo. It is considered for Comparative Example 3 that growth of nuclei is insufficient because of insufficiency of Cr. It is considered for Comparative Example 5 that precipitation of carbides was insufficient because of insufficiency of C (carbon) itself. It is considered for Comparative Examples 7 and 8 that nuclei of carbides were scarcely formed at the final stage of sintering since V was not contained as ingredient. Further, it is considered that growth of nuclei was also insufficient since Cr was not present as ingredient. It is considered for Comparative Example 10 that growth of nuclei was insufficient since it was quenched after sintering as it was (process F. described above).

Tables 6 and 7 show precipitation amount for each of the elements as the carbides in each of the sintered alloys after tempering, resistance to surface contact fatigue and the wear depth upon wear test. Precipitation amounts are amounts of elements in carbides extracted by chemically dissolving from the matrix. The values are expressed as mass % based on the entire sintered alloy. It can be seen from the comparison with the value for each of the ingredients in Table 4 that about 55 to 70% of V, about 25 to 60% of each of the elements of Cr and Mo were precipitated as carbides in the sintered alloys of the examples. It is considered that the remaining portions of the elements were solid solved in the matrix. The resistance to the surface pressure fatigue is a value measured by a radial type rolling fatigue tester. Each of the examples shows favorable value. However, in comparative examples, those of insufficient resistance to the surface contact fatigue are observed. They are Comparative Examples 3, 5, 9, and 10. It is considered that this is attributable to the insufficiency of precipitates of carbides like in the case of the Vickers hardness described above.

Figure 5:
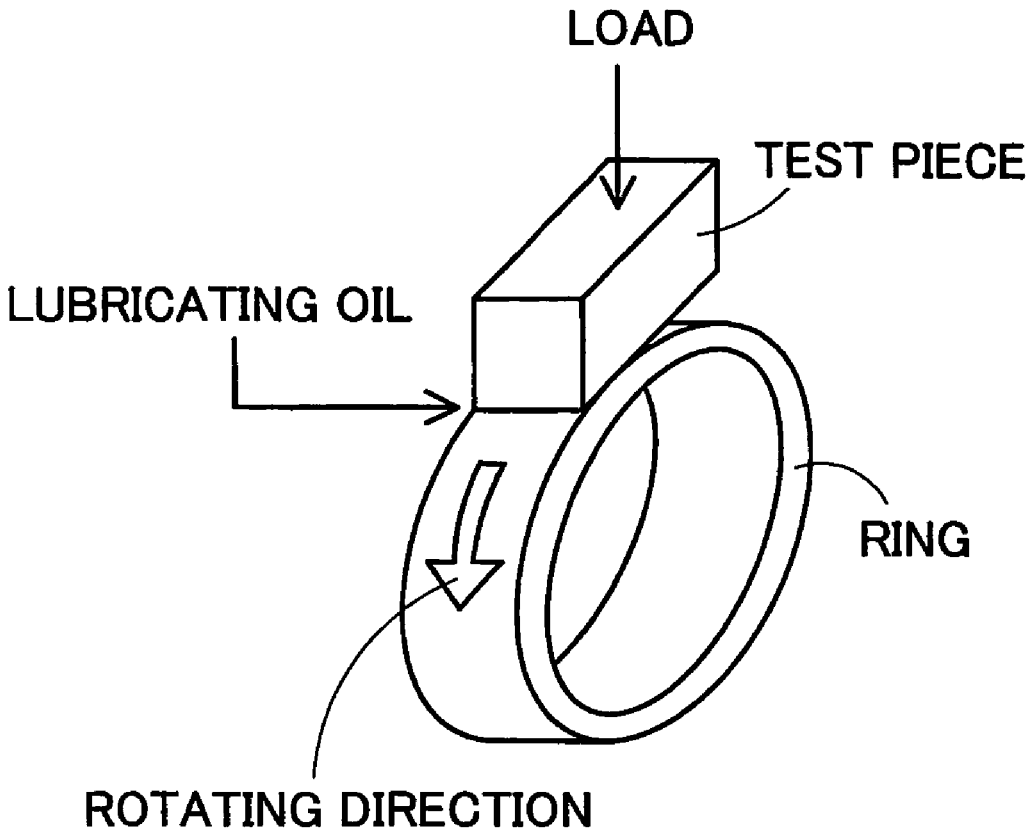
FIG. 5 is a view for explaining a test method for wear resistance and hostility to mating materials.

For the wear depth, a sintered alloy in each of the examples and the comparative examples was used as test piece and tested as shown by the method in FIG. 5. Testing conditions are as shown below;

Material for ring: SAE 4620 steel, applied with carburizing and hardening, and lubrite treatments after tempering, Number of rotation of ring: 150 rpm Load: 690 N Test time: 90 min Type of lubricant: 5W-30 grade base oil Dripping amount of lubricant: 2 $cm^3$/min A new ring was used on every test.

In Tables 6 and 7, values shown in the column for "Own" mean wear depth of a test specimen after the test under the conditions described above. Accordingly, each of the values in the column shows the extent of wear resistance of the sintered alloy itself in each of the examples and the comparative examples. It can be said that a smaller value shows a more excellent wear resistance. In each of the examples, the wear depth was utmost about 10 μm. Accordingly, it can be said that each of the examples is excellent in the wear resistance. However, in the comparative examples, those with larger values were observed. They are Comparative Examples 1, 3, and 7 to 10. They substantially agree with those which were poor in the Vickers hardness and the resistance to the surface pressure fatigue. Accordingly, it is considered that the insufficient precipitation of carbides caused deficiency. In Example 8, since the sintering temperature was low, the amount of oxygen in Table 4 is somewhat high as 0.23 mass %. Accordingly, resistance to surface contact fatigue is at a level somewhat lower compared with other examples. However, for wear depth, a sufficiently favorable value is ensured.

TABLE 6

| Example | Precipitation Amount (mass %) | | | Resistance to surface contact | Wear depth (μm) | |
|---|---|---|---|---|---|---|
| No. | Cr | Mo | V | fatigue (GPa) | Own | Mating material |
| 1 | 0.62 | 0.28 | 0.13 | 2.7 | 10.5 | 0.1 |
| 2 | 0.81 | 0.22 | 0.26 | 3.2 | 6.4 | 0.2 |
| 3 | 0.81 | 0.12 | 0.20 | 3.3 | 6.7 | 0.3 |
| 4 | 0.82 | 0.11 | 0.14 | 3.0 | 7.2 | 0.2 |
| 5 | 0.71 | 0.20 | 0.10 | 2.9 | 8.3 | 0.3 |
| 6 | 0.63 | 0.26 | 0.13 | 3.1 | 7.9 | 0.2 |
| 7 | 0.81 | 0.08 | 0.22 | 3.1 | 6.3 | 0.2 |
| 8 | 0.80 | 0.09 | 0.21 | 2.8 | 6.5 | 0.2 |

TABLE 7

| Comp. Example | Precipitation Amount (mass %) | | | Resistance to surface contact | Wear depth (μm) | |
|---|---|---|---|---|---|---|
| No. | Cr | Mo | V | fatigue (GPa) | Own | Mating material |
| 1 | 0.52 | 0.07 | — | 2.6 | 14.5 | 0.1 |
| 2 | 0.52 | 0.08 | 0.42 | 2.6 | 7.1 | 2.0 |
| 3 | 0.05 | 0.06 | 0.13 | 2.2 | 15.1 | 0.6 |
| 4 | 1.52 | 0.12 | 0.20 | 2.9 | 5.2 | 1.2 |
| 5 | 0.83 | 0.09 | 0.11 | 2.3 | 11.4 | 0.5 |
| 6 | 0.81 | 0.12 | 0.28 | 3.2 | 7.0 | 1.4 |
| 7 | — | 0.13 | — | 2.7 | 18.2 | 0.2 |
| 8 | — | 0.03 | — | 2.6 | 20.7 | 0.3 |
| 9 | 0.43 | 0.02 | — | 2.3 | 23.4 | 0.2 |
| 10 | 0.06 | 0.03 | 0.20 | 2.4 | 20.2 | 0.2 |

Precipitates in the sintered alloy in each of the examples after tempering was observed by a transmission electron microscope and crystal system was identified by electron diffraction. As a result, it was confirmed that most of precipitates were $M_7C_3$ ($M_3C$ was present somewhat). Further, it was confirmed that a great amount of precipitates having a square shape with the crystal orientation thereof being aligned with the crystal orientation of the matrix were present. There are coherent precipitates. If precipitates are coherent, the precipitates less allow dislocations to pass through. This leads to improvement of hardness. Further, after etching, mirror polished surfaces of the sintered alloys were observed by a scanning electron microscope. Thus, average grain size of precipitates was measured. It was 400 nm or less in any of the cases as an average for the precipitates by the number of 100 in each case.

On the other hand, in Tables 6 and 7, values shown in the column for "Mating material" are decrements for thickness of the rings after the test under the conditions described above. Accordingly, each value in the column shows the extent that the sintered alloy in each of the examples and the comparative examples abrades mating materials in sliding movement, that is, the extent of hostility to mating materials. It can be said that a smaller value shows more excellent reduced hostility to mating materials. In each of the examples, wear depth is about 0.3 μm at the greatest. Thus, it can be said that each of the examples is excellent in reduced hostility to mating materials. However, values are larger in Comparative Examples 2, 4, and 6. It is considered that larger hostility to mating materials in the comparative examples is attributable to the incorporation of coarse precipitates. This is because they contain excessive ingredients of carbides, for example, V in Comparative Example 2, Cr in Comparative Example 4, and C in Comparative Example 6. For Comparative Examples 2, 4, and 6, precipitates in the sintered alloys after tempering were actually observed by a transmission electron microscope and the crystal systems were identified by electron diffraction. As a result, most of the precipitates were $M_7C_3$, and $M_3C$ was also present to some extent. Further, mirror polished surfaces of the sintered alloys were observed after etching by a scanning electron microscope. Thus, average grain size of the precipitates was measured. In each of the comparative examples, it exceeded 400 nm as an average for precipitates by the number of 100 in each case.

In Comparative Examples 1, 3, 5, and 7 to 10, wear depths for their own were large exceeding 10 μm and wear resistance is insufficient. It is considered that this is attributable to the insufficiency of the content for one or more of Cr, Mo and C in the sintered alloy. It is accordingly considered that $M_7C_3$ carbides were not sufficiently precipitated and grown, so that sintered products of high hardness could not be obtained. Actually, for the comparative examples, precipitates in the sintered alloys after tempering were observed by a transmission electron microscope, and the crystal systems were identified by electron diffraction. As a result, number of precipitates was remarkably smaller compared with the examples and the Comparative Examples 2, 4, and 6 described previously.

From the foregoing, it can be seen that no comparative example is excellent both in own wear resistance and in reduced hostility to mating materials.

Further, sintered alloys were manufactured with the compositions of Example 8 in Table 2, which were used for the test of retention temperature before quenching and of retention time at the retention temperature. Sintering in this case was conducted under the following conditions.

Compacting (686 MPa)

↓

Pre-sintering (850° C., 30 min.)

↓

Repressing (686 MPa)

↓

Resintering (1250° C., 30 min.)

Tempering after quenching was conducted under the following conditions.

Pre-tempering (180° C., 90 min.)

↓

Usual tempering (250° C., 30 min.)

The usual tempering described above corresponds to shrinkage fitting.

TABLE 8

| Condition | Retention temperature ° C. | Quenching temperature ° C. |
|---|---|---|
| 1 | 820 | 805 |
| 2 | 840 | 825 |
| 3 | 860 | 845 |
| 4 | 885 | 870 |
| 5 | 910 | 895 |

In the test for retention temperature, quenching was conducted under each of the conditions shown in Table 8 after once lowering the temperature of the alloy after sintering to room temperature. Retention time at the retention temperature was set to 30 min. in each of the cases and quenching method was oil quenching. Thus, results shown in Table 9 were obtained for amount of precipitation as carbides for each of the elements in the sintered products and Vickers hardness after tempering (HV, according to JIS Z 2244). Thus, precipitation amount at a level equivalent with that in each of the examples in Table 6 was obtained for each of the elements Cr, Mo and V at any of the retention temperatures of 820 to 910° C. Further, Vickers hardness after tempering was also ensured sufficiently at any of the retention temperatures.

TABLE 9

| | Precipitation amount (mass %) | | | Hardness HV | |
|---|---|---|---|---|---|
| Condition | Cr | Mo | V | After temporary tempering | After usual tempering |
| 1 | 1.0 | 0.12 | 0.24 | 759 | 709 |
| 2 | 0.98 | 0.12 | 0.23 | 819 | 739 |
| 3 | 0.88 | 0.12 | 0.23 | 806 | 756 |
| 4 | 0.75 | 0.11 | 0.22 | 832 | 732 |
| 5 | 0.60 | 0.12 | 0.22 | 835 | 705 |

In the test for retention time, after once lowering temperature of the alloy after sintering to room temperature, quenching was conducted under each of the conditions shown in the column for "Retention time" in Table 10. Retention temperature was set to 865° C. in each of the cases and quenching method was gas quenching (nitrogen: 1 MPa). The column for "On program" in "Retention time" shows the retention time in view of the program. Since there is a delay in temperature elevation in actual works, actual retention time is shorter. Then, based on the result of temperature measurement, time in which the actual work was retained within a range of ±5° C. for the retention temperature is shown in the column for "Real time". The retention time means hereinafter the real time. As a result, the Vickers hardness (HV, according to JIS Z 2244) after usual tempering under each of the conditions was a value shown in the column for "hardness HV" in Table 10. According to this, the Vickers hardness after the usual tempering was somewhat lower in the retention time for 5 min, compared with that in the retention time of 25 min or more. It is substantially saturated for retention time of 25 min or more. Thus, it can be seen that the retention time is preferably 25 min or more.

TABLE 10

| | Retention time (min) | | Hardness HV |
|---|---|---|---|
| Condition | On program | Real time | After usual tempering |
| 6 | 25 | 5 | 698 |
| 7 | 45 | 25 | 720 |
| 8 | 50 | 30 | 721 |
| 9 | 70 | 50 | 723 |

As has been described specifically above, according to this embodiment and the examples, the composition for Cr, Mo, V (group 4a or group 5a metal) and C was defined within the predetermined range, and after cooling once subsequent to the high temperature sintering, heating was conducted again to apply quenching. Thus, it is obtained an iron-based sintered alloy in a state where fine $M_7C_3$ precipitates are dispersed in a matrix of martensitic texture. Since this makes the sintering process as solid phase sintering, shape accuracy and surface flatness are excellent. Further, due to precipitation hardening by carbides, sufficient hardness and strength can be obtained even after tempering and wear resistance is also excellent. Further, since precipitates are not coarse, hostility to mating materials in sliding movement is reduced. Thus, there is attained an iron-based sintered alloy, as well as a manufacturing method thereof, capable of a net shape member integrated with other member (shaft) by shrinkage fitting such as a cam piece and put in a state of sliding movement with other member (cam follower) during use. This can save finishing grinding operation in the process. Accordingly, degree of freedom in the profile can be extended more.

This embodiment and examples are shown merely as examples and they no way restrict the present invention. Accordingly, the present invention can be naturally improved and modified variously within a scope not departing from the gist thereof. For example, the member as an object for application is not restricted to cam piece but it is applicable to any member requiring wear resistance and the like. In this case, in an application use requiring the wear resistance, but having a margin for strength or resistance to surface contact fatigue, sintering temperature may be at about 1120° C. Further, since resistance to temper softening is high and, resistance to surface contact stress is large; it is also suitable to such application uses as particularly requiring pitching resistance such as gears.

INDUSTRIAL APPLICABILITY

As is apparent in view of the descriptions above, the present invention provides an iron-based alloy excellent in shape accuracy and wear resistance, and reduced hostility to mating materials, and also having a sufficient hardness after tempering, as well as a manufacturing method thereof. This can cope with the demand for net shaping of members, for example, a cam piece.

The invention claimed is:

1. An iron-based sintered alloy, comprising:

carbides in a matrix comprising martensite, the carbides comprising:

$Cr_7C_3$ carbides;

$Mo_7C_3$ carbides; and $M_7C_3$ carbides, wherein M represents one or more of members selected from the group consisting of group 4a or group 5a metals;

wherein the carbides in the matrix have a composition comprising

Cr: in an amount of 1 to 3.5 mass %;

Mo: in an amount of 0.2 to 0.9 mass %;

M: in an amount of 0.1 to 0.5 mass % when M is the group 5a metal V, and in an amount satisfying the following condition when M is a group 4a or group 5a metal other than V:

$$(Q_m/a_m)\times a_v=0.1 \text{ to } 0.5 \text{ mass } \%$$

wherein $Q_m$ is a mass % of M other than V, $a_m$ is an atomic weight of M other than V, and $a_v$ is an atomic weight of V;

C: in an amount of 0.72 to 0.95 mass %;

Mn: in an amount of 0.7 mass % or less; and a balance of Fe and impurities.

2. An iron-based sintered alloy according to claim 1, wherein average grain size of the carbides is 400 nm or less.

3. An iron-based sintered alloy according to claim 1, wherein ratio of Cr, Mo, and M in the carbides based on the entire iron-based sintered alloy is within a range of Cr: from 0.6 to 0.9 mass %, Mo: from 0.05 to 0.3 mass %, and M: from 0.1 to 0.4 mass % when M is the group 5a metal V.

4. An iron-based sintered alloy according to claim 1, wherein oxygen content is less than 0.2 mass %.

5. An iron-based sintered alloy according to claim 2, wherein ratio of Cr, Mo, and group 4a or group 5a metal in the carbides based on the entire iron-based sintered alloy is within a range of Cr: from 0.6 to 0.9 mass %, Mo: from 0.05 to 0.3 mass %, and M: from 0.1 to 0.4 mass % when M is the group 5a metal V.

6. An iron-based sintered alloy according to claim 2, wherein oxygen content is less than 0.2 mass %.

7. An iron-based sintered alloy according to claim 3, wherein oxygen content is less than 0.2 mass %.

8. An iron-based sintered alloy according to claim 5, wherein oxygen content is less than 0.2 mass %.

9. A method of manufacturing an iron-based sintered alloy, comprising the steps of:

mixing alloy powder of a composition comprising

Cr: in an amount of 1 to 3.5 mass %,

Mo: in an amount of 0.2 to 0.9 mass %,

M, wherein M represents one or more of members selected from the group consisting of group 4a or group 5a metals, and wherein M is in an amount of 0.1 to 0.5 mass % when the M is V, and in an amount satisfying the following condition when M is a group 4a or group 5a metal other than V:

$$(Q_m/a_m)\times a_v=0.1 \text{ to } 0.5 \text{ mass } \%$$

wherein $Q_m$ is a mass % of M other than V, $a_m$ is an atomic weight of M other than V, and $a_v$ is an atomic weight of V, Mn: in an amount of 0.7 mass % or less, and a balance of Fe and impurities, and carbon powder within a range by which a carbon content of the manufactured sintered alloy is from 0.72 to 0.95 mass %;

compacting the mixture;

sintering the compacted mixture; and quenching the sintered mixture heated to a temperature of 800° C. or higher after temperature of the sintered mixture is lowered to 150° C. or lower.

10. A method of manufacturing an iron-based sintered alloy according to claim 9, wherein retention temperature during sintering is 1200° C. or higher.

11. A method of manufacturing an iron-based sintered alloy according to claim 9, wherein retention temperature before quenching is within a range from 820 to 910° C.

12. A method of manufacturing an iron-based sintered alloy according to claim 11, wherein retention time at retention temperature before quenching is 25 minute or more.

13. A method of manufacturing an iron-based sintered alloy according to claim 10, wherein retention temperature before quenching is within a range from 820 to 910° C.

14. A method of manufacturing an iron-based sintered alloy according to claim 13, wherein retention time at retention temperature before quenching is 25 minutes or more.

* * * * *